US007234925B2

(12) United States Patent
Beaven et al.

(10) Patent No.: US 7,234,925 B2
(45) Date of Patent: Jun. 26, 2007

(54) SCREW PUMP

(75) Inventors: Robert William Beaven, Bristol (GB); Michael John Werson, Eastleigh (GB)

(73) Assignee: Automotive Motion Technology Limited (GB)

( * ) Notice: Subject to any disclaimer, the term of this patent is extended or adjusted under 35 U.S.C. 154(b) by 0 days.

(21) Appl. No.: 11/269,077

(22) Filed: Nov. 8, 2005

(65) Prior Publication Data

US 2006/0216190 A1 Sep. 28, 2006

(30) Foreign Application Priority Data

Nov. 8, 2004 (GB) ..... 0424557.7

(51) Int. Cl.
*F01C 1/08* (2006.01)
*F03C 2/00* (2006.01)
*F04C 18/00* (2006.01)

(52) U.S. Cl. ..... 418/197; 418/201.1

(58) Field of Classification Search ..... 418/196, 418/197, 201.1, 206.1, 206.5, 180
See application file for complete search history.

(56) References Cited

U.S. PATENT DOCUMENTS

| | | | | |
|---|---|---|---|---|
| 630,648 | A | 8/1899 | Brewer | |
| 2,079,083 | A * | 5/1937 | Montelius | 418/197 |
| 2,231,357 | A | 2/1941 | Beughauser et al. | |
| 2,455,022 | A | 11/1948 | Schmidt | |
| 2,481,527 | A | 9/1949 | Nilsson | |
| 2,588,888 | A | 3/1952 | Sennett | |
| 2,590,560 | A | 3/1952 | Montelius | |
| 2,652,192 | A | 9/1953 | Chilton | |
| 2,693,763 | A | 11/1954 | Sennet | |
| 2,764,101 | A * | 9/1956 | Rand | 415/72 |
| 3,063,379 | A | 11/1962 | Montelics | |
| 3,291,061 | A | 12/1966 | Shinohara | |
| 3,519,375 | A | 7/1970 | Sennet et al. | |
| 3,574,488 | A | 4/1971 | Vanderstegen-Drake | |
| 3,773,444 | A | 11/1973 | Koch | |
| 3,814,557 | A | 6/1974 | Volz | |
| 6,158,996 | A | 12/2000 | Becher | |
| 6,312,242 | B1 | 11/2001 | Fang et al. | |

(Continued)

FOREIGN PATENT DOCUMENTS

| | | |
|---|---|---|
| DE | 1004930 | 8/1957 |

(Continued)

OTHER PUBLICATIONS

United Kingdom Search Report issued in priority application GB 0424557.7.

*Primary Examiner*—Theresa Trieu
(74) *Attorney, Agent, or Firm*—Dykema Gossett PLLC

(57) ABSTRACT

A pump including a power rotor and an idler rotor, the rotors each being provided with a generally helical screw thread and being mounted for rotation in a housing such that the screw threads of the rotors mesh and rotation of one rotor causes rotation of the other rotor, the power rotor being connected to a driving means operation of which causes rotation of the power rotor, wherein the pitch of the threads is less than 1.6 times the outer diameter of the power rotor, the depth of the threads is less than or equal to 0.2 times the outer diameter of the power rotor, and the root diameter of the idler rotor is less than 0.31 times the outer diameter of the power rotor.

15 Claims, 3 Drawing Sheets

U.S. PATENT DOCUMENTS

2004/0258550 A1* 12/2004 Beaven et al. ..... 418/197

FOREIGN PATENT DOCUMENTS

| | | | |
|---|---|---|---|
| DE | 3718863 | A1 | 12/1988 |
| EP | 1008755 | A | 6/2000 |
| EP | 1475537 | A1 | 11/2004 |
| GB | 906430 | | 9/1962 |
| GB | 909922 | | 11/1962 |
| GB | 914658 | | 1/1963 |
| GB | 954426 | | 4/1964 |
| GB | 2352777 | A | 2/2001 |

* cited by examiner

SCREW PUMP

This application claims priority to United Kingdom Patent Application No. 0424557.7 filed Nov. 8, 2004, the entire disclosure of which is incorporated herein by reference.

FIELD OF THE INVENTION

The present invention relates to a pump, more particularly to a pump in which pumping is effected by means of at least two intermeshing screw threads, i.e. an intermeshing screw pump.

DESCRIPTION OF THE PRIOR ART

Pumps in which the pumped fluid is carried between the screw threads on one or more rotors such that the liquid is displaced in a direction generally parallel to the axis of rotation of the or each rotor, are known, and are generally referred to as screw pumps.

Where more than one rotor is provided, the pump is generally known as an intermeshing screw pump. In this case, one rotor is provided with one or more helical grooves and another rotor is provided with one or more corresponding helical ridges. Typically one of the rotors (the power rotor) is driven by motor, which when activated causes the power rotor to rotate along its longitudinal axis. The rotors are mounted in a housing such that their helical screw threads mesh and rotation of the power rotor causes the other rotor or rotors (the idler rotor or rotors) to rotate about its/their longitudinal axis or axes.

Fluid is drawn into the pump at an inlet or suction end of the pump between the counter-rotating screw threads. As the rotors turn the meshing of the threads produces fluid chambers bounded by the threads and the pump housing. Fluid becomes trapped in the fluid chambers and continued rotation of the screws causes the fluid chambers to move from the inlet end of the pump to the high pressure outlet end of the pump. Fluid is ejected from the pump at the outlet end as fluid is displaced from the fluid chambers.

It is known to increase the pressure of the fluid output from such a pump by increasing the length of the screws, and as a consequence known high pressure screw pumps tend to be relatively long and are thus unsuitable for use in applications where high output pressure and a compact pump is required, for example in automotive applications where space in an engine compartment is limited.

SUMMARY OF THE INVENTION

According to a first aspect of the invention we provide a pump including a power rotor and an idler rotor, the rotors each being provided with a generally helical screw thread and being mounted for rotation in a housing such that the screw threads of the rotors mesh and rotation of one rotor causes rotation of the other rotor, the power rotor being connected to a driving means operation of which causes rotation of the power rotor, wherein the pitch of the threads is less than 1.6 times the outer diameter of the power rotor, the depth of the threads is less than or equal to 0.2 times the outer diameter of the power rotor, and the root diameter of the idler rotor is less than 0.31 times the outer diameter of the power rotor.

In known intermeshing screw pumps, the pitch of the threads, i.e. the axial distance between corresponding points on adjacent turns of the thread, is typically twice the outer diameter of the rotors or larger diameter rotor, and may be up to 2.4 times the outer diameter of the rotors or larger diameter rotor. Thus, for a given pump length, more fluid chambers are formed in a pump according to the invention than in a conventional pump, i.e. for a given number of fluid chambers, a pump according to the invention is shorter than a conventional pump. Since the pressure of fluid output from an intermeshing screw pump depends, in part, on the number of fluid chambers formed by the screw threads of the rotors, for a given pressure, a pump according to the invention may be shorter than a conventional pump. Thus, by virtue of the invention, a screw pump may be produced which is capable of delivering high pressure fluid and which is more suitable for use in confined spaces such as those found within an engine compartment of an automotive vehicle.

In conventional screw pumps, the thread depth of the screw threads is greater than 0.2 times the diameter of the larger diameter rotor. Whilst, decreasing the thread depth decreases the volume of each fluid chamber, and thus tends to decrease the volume output of the pump, use of a reduced thread depth has particular advantages.

One advantage of reducing the thread depth is that decreasing the thread depth also decreases the area of leakage paths which permit leakage of fluid from the fluid chambers, and thus reduces leakage from the fluid chambers and hence increases the volumetric efficiency of the pump. In addition, for a given rotor root diameter (the rotor outer diameter minus twice the thread depth), the overall diameter of a pump according to the invention may be reduced. Rotors with threads of lower depth are also easier and thus less expensive to machine. Thus, a more compact and more efficient pump may be produced at reduced manufacturing cost. Any reduction in output volume may be compensated for by increasing the speed of rotation of the rotors.

Preferably the pitch of the threads is less than or equal to the outer diameter of the power rotor. The pitch of the threads may be at least 0.5 times the outer diameter of the power rotor, and may be at least 0.8 times the outer diameter of the power rotor.

Preferably the thread depth of the screw threads is less than 0.175 times the outer diameter of the power rotor, and may be at least 0.1 times the outer diameter of the power rotor.

Preferably, the root diameter of the idler rotor is less than 0.3 times the outer diameter of the power rotor, and is ideally at least 0.1 times the outer diameter of the power rotor. The root diameter of the idler rotor may be between 0.2 and 0.3 times the outer diameter of the power rotor.

Preferably the length of the power rotor and idler rotor is less than 200 mm, and may be less than 100 mm. The outer diameter of the power rotor is preferably less than 12 mm.

Each rotor may be provided with two generally helical interposed screw threads.

The pump may include a power rotor and two idler rotors, the power rotor being arranged between the two idler rotors. Preferably the pitch of the threads is substantially constant over the length of the rotors.

DESCRIPTION OF THE DRAWINGS

Embodiments of the invention will now be described with reference to the accompanying drawings in which.

Figure 1:
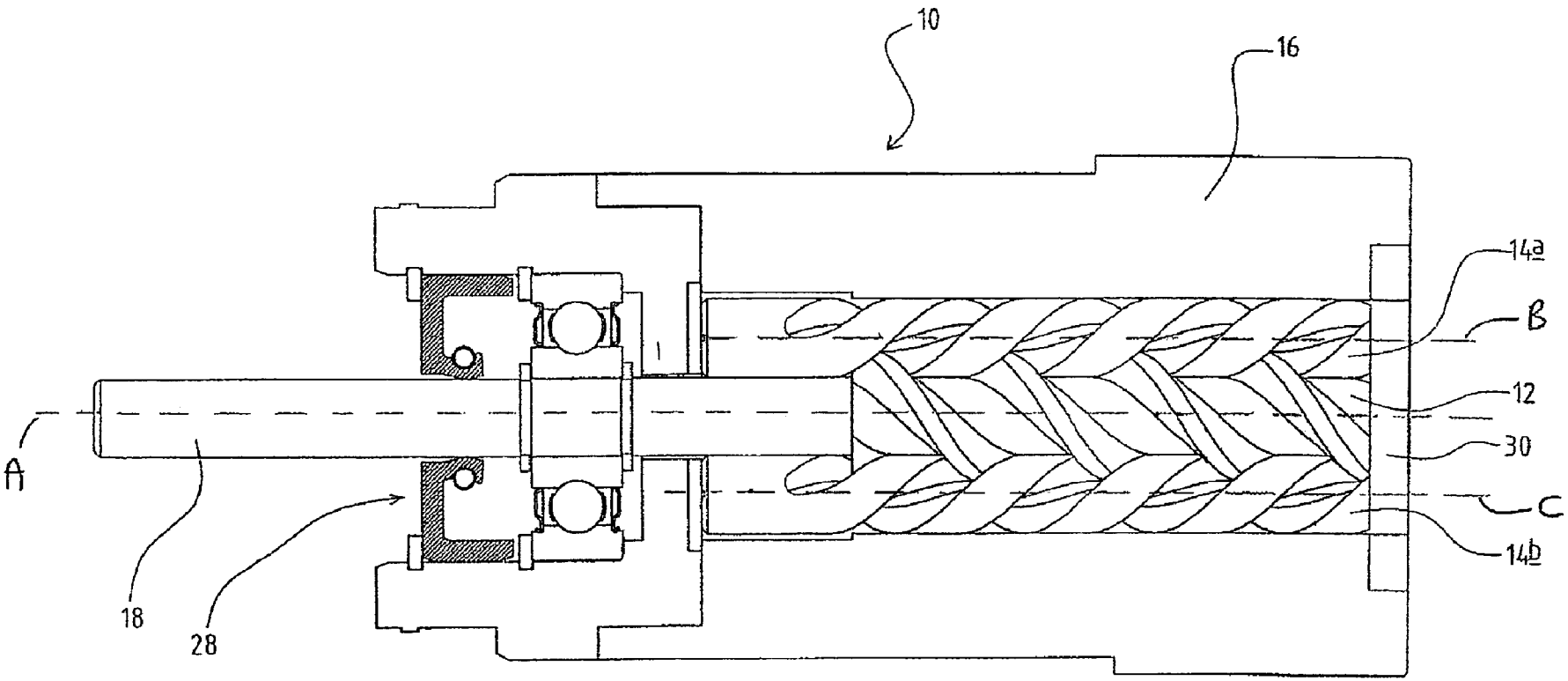
FIG. 1 is a side sectional illustrative view of a pump according to the invention.

It should be appreciated that the drawings are for illustrative purposes only, and do not show the relative dimensions of the thread forms to scale.

DESCRIPTION OF THE PREFERRED EMBODIMENTS OF THE INVENTION

Referring now to the figures there is shown a pump 10 including a central power rotor 12 and two idler rotors 14*a*, 14*b*, all mounted for rotation about their longitudinal axes in a housing 16. The power rotor 12 is connected to a driving means by means of a drive shaft 18, in this case an electric motor (not shown) which when activated, causes the power rotor 12 to rotate about its longitudinal axis A. The drive shaft 18 is supported in a bearing assembly 28.

The power rotor 12 has a larger outside diameter than the two idler rotors 14*a*, 14*b*.

Each rotor 12, 14*a*, 14*b* is provided with a generally helical screw thread, and the rotors 12, 14*a*, 14*b* are arranged in the housing 16, with the power rotor 12 between the two idler rotors 14*a*, 14*b*, such that the screw threads mesh. The longitudinal axes A, B and C of the rotors 12, 14*a* are generally parallel, and thus rotation of the power rotor 12 about axis A causes the idler rotors 14*a*, 14*b* to rotate about their longitudinal axes, B and C respectively.

Figure 3:
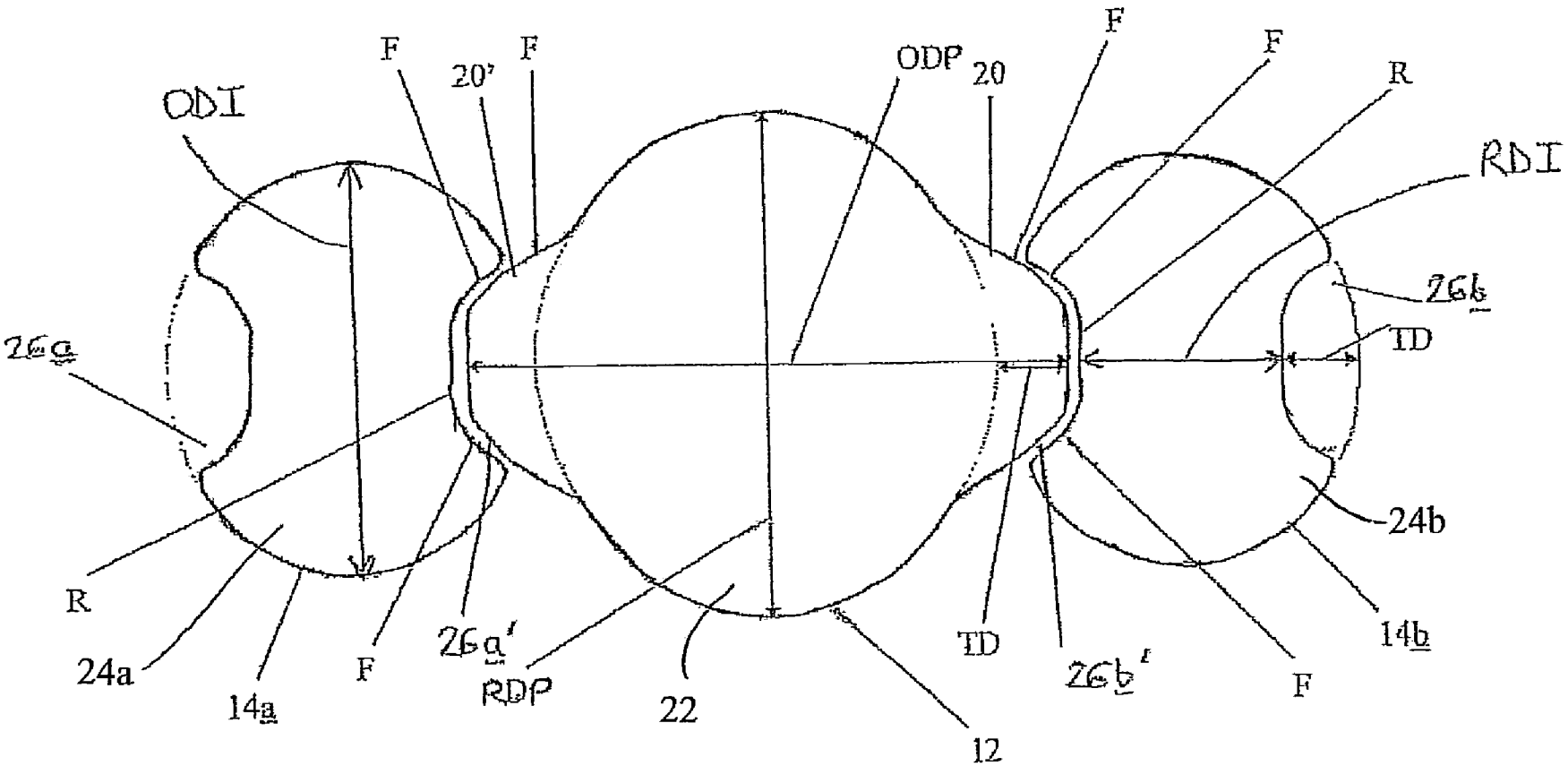
FIG. 3 is an illustrative end cross-sectional view through the rotors of the pump shown in FIG. 1.

In this example, the rotors 12, 14*a*, 14*b* are all provided with two generally helical threads or flights which each extend along substantially the entire length of the rotor 12, 14*a*, 14*b*, and which are interposed such that when the rotor 12, 14*a*, 14*b* is viewed in transverse cross-section, as shown in FIG. 3, one thread is diametrically opposite the other. The power rotor 12 has the shape of a generally cylindrical shaft 22 with the threads 20, 20', two generally helical ridges, extending radially outwardly around the shaft 22. The idler rotors 14*a*, 14*b* each have the shape of a generally cylindrical shaft 24*a*, 24*b* with the threads 26*a*, 26*a'*, 26*b*, 26*b'*, two generally helical grooves, extending radially inwardly into each shaft 24*a*, 24*b*.

An inlet port (not shown) is provided in the pump housing 16 adjacent a first end of the rotors 12, 14*a*, 14*b* and an outlet port 30 is provided in the pump housing 16 adjacent a second, opposite end of the rotors 12, 14*a*, 14*b*.

The pump is operated as follows.

The motor is activated to cause rotation of the power rotor 12 about axis A, which in turn causes rotation of the idler rotors 14*a*, 14*b* in the housing 16 about axes B and C respectively. Fluid is drawn into the inlet between the threads 20, 20', 26*a*, 26*a'*, 26*b*, 26*b'* at the first ends of the rotors. As the rotors turn, the meshing of the threads produces fluid chambers bounded by the thread roots R, the thread flanks F and the pump housing 16. Fluid becomes trapped in the fluid chambers and continued rotation of the screws causes the fluid chambers to move from the first end of the rotors 12, 14*a*, 14*b* to the second end of the rotors 12, 14*a*, 14*b*. Fluid is ejected from the pump 10 via the outlet port 30 as a consequence of fluid being displaced from the fluid chamber as the screw threads at the second end of the rotors 12, 14*a*, 14*b* mesh.

Figure 2:
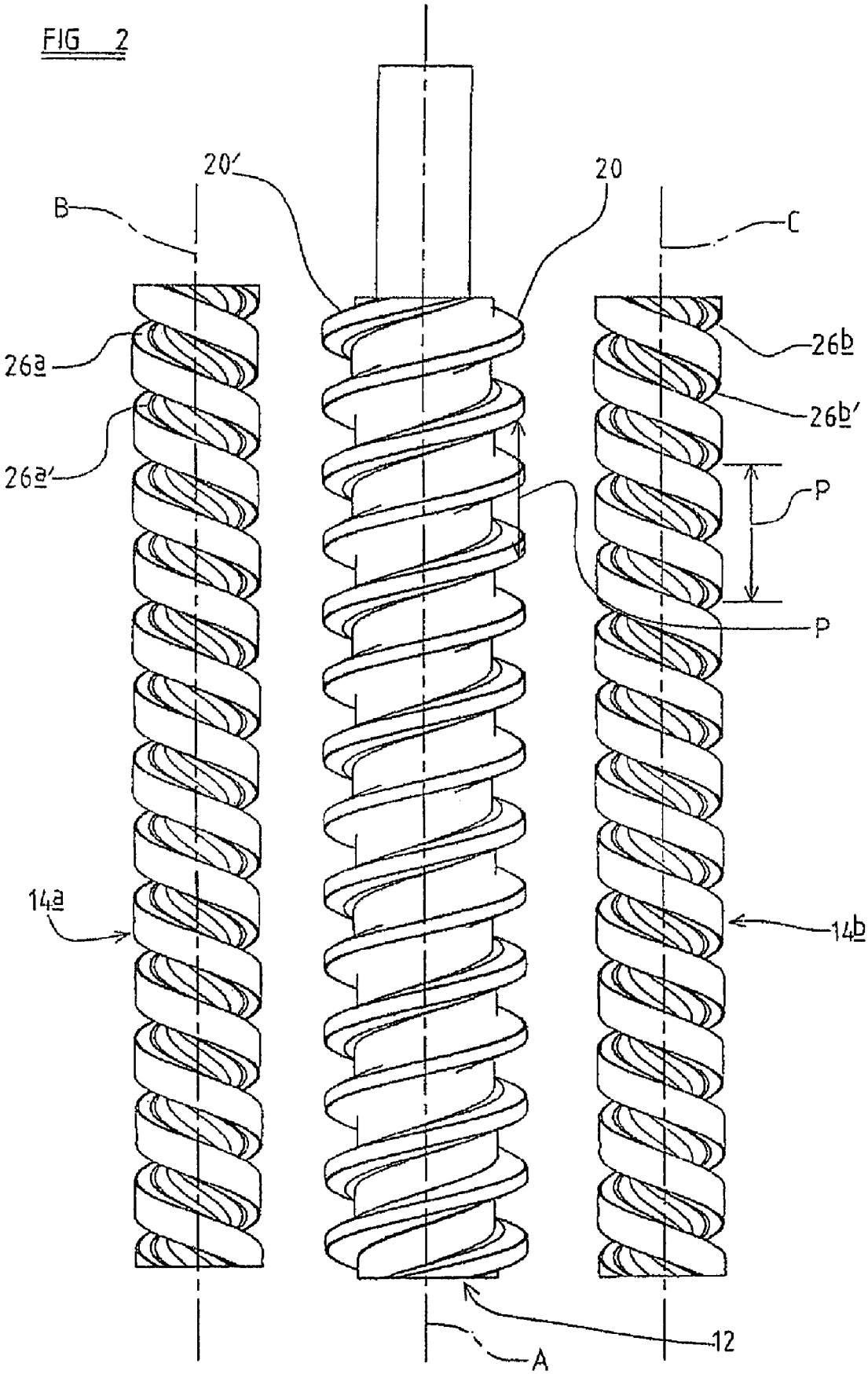
FIG. 2 is an enlarged illustrative view of the rotors of the pump of FIG. 1, the rotors being arranged in an inoperative position, side by side.

The pitch of each thread 20, 20', 26*a*, 26*a'*, 26*b*, 26*b'*, i.e. the distance between corresponding points on adjacent loops of one of the threads 20, 20', 26*a*, 26*a'*, 26*b*, 26*b'*, marked as P on FIG. 2, is generally constant along the entire length of the rotors 12, 14*a*, 14*b* and is less than 1.6 times the outer diameter of the power rotor, marked as ODP in FIG. 3. Preferably the pitch is less than or equal to and at least 0.5 times the outer diameter ODP of the power rotor 12.

For example, for a power rotor outer diameter ODP of between 10 mm and 12 mm, the pitch P of the threads 20, 20', 26*a*, 26*a'*, 26*b*, 26*b'* is typically from 6 up to 12 mm. In a preferred embodiment of the invention, the power rotor outer diameter ODP is 10.8 mm and the pitch P is 10.666 mm.

The depth of each thread 20, 20', 26*a*, 26*a'*, 26*b*, 26*b'*, marked on FIG. 3 as TD, is less than 0.2 times the outer diameter of the power rotor 12. In this example, the outer diameter ODP of the power rotor 12 is between 10 mm and 12 mm and the thread depth TD is between 1.4 and 2 mm inclusive. In the preferred embodiment of the invention the thread depth TD is 1.8 mm.

The root diameter of the idler rotors 14*a*, 14*b*, marked as RDI on FIG. 3, is less than 0.31 times the outer diameter ODP of the power rotor 12. If the rotor diameter RDI is too small, for a pump of these dimensions, the idler rotors 14*a*, 14*b* would buckle during machining or use, and therefore the root diameter RDI is greater than 0.1 times the outer diameter ODP of the power rotor 12, and is preferably between 0.2 and 0.3 times the outer diameter ODP. In the preferred embodiment of the invention, the root diameter of the idler rotors 14*a*, 14*b* is around 3.2 mm.

The outer diameter of the idler rotors 14*a*, 14*b*, marked as ODI on FIG. 3, is therefore less than or equal to 0.71 times the outer diameter ODP of the power rotor 12, and is preferably less than 0.65 times the outer diameter ODP of the power rotor 12. In the preferred embodiment of the invention, the outer diameter ODI of the idler rotors 14*a*, 14*b* is around 6.8 mm.

In known intermeshing screw pumps of a similar size, the pitch P of the threads 20, 20', 26*a*, 26*a'*, 26*b*, 26*b'* is typically twice the outer diameter OD of the power rotor 12, and may be up to 2.4 times the outer diameter OD of the power rotor 12, whereas the thread depth TD is 0.2 times the outer diameter OD of the power rotor 12.

Thus, for a given pump length, more fluid chambers are formed in a pump 10 according to the invention than in a conventional pump, or, put another way, for a given number of fluid chambers, the pump 10 is shorter than a conventional pump. Since the pressure of fluid output from an intermeshing screw pump 10 depends on the number of fluid chambers formed by the screw threads 20, 20', 26*a*, 26*a'*, 26*b*, 26*b'* of the rotors 12, 14*a*, 14*b*, for a given pressure output, the pump 10 may be shorter than a conventional pump.

In the preferred embodiment of the invention, the length of the power rotor 12 and the idler rotors 14*a*, 14*b* is around 60-70 mm, typically 65 mm, and the pump 10 is capable of producing fluid pressurised to around 100 bar at flow rates of 8-10 litres per minute, depending of the pump speed.

Moreover, since the thread depth TD is lower than for a conventional pump, for a given power rotor 12 root diameter RDP, the overall pump diameter may be smaller than for a conventional pump.

Thus the pump 10 can be used where space is restricted such as in automotive applications, for example in an electrically operated power pack in which the pump is activated to produce pressurised fluid and the pressurised fluid is used to move an actuator member. Such an electrically powered power pack may be required for applications such as power steering.

It is advantageous to use a screw pump in such applications as screw pumps are relatively quiet compared with vane and gear pumps, for examples, and require only a relatively small motor in order to run at the high speeds, e.g. over 7,500 rpm, required to produce the fluid volume output needed for such applications.

The reduction in thread depth TD described above does have a consequence of reducing the volume of each fluid chamber in the pump 10, which in turn reduces the volume output of the pump when operating at a particular speed, but this can be compensated for by increasing the speed of rotation of the pump.

Use of the screw thread form described above also improves the efficiency of the pump 10. A screw pump using a conventional thread form which was scaled down to produce a pump of the same dimensions as a pump 10 according to the invention, operated at under 20% efficiency, whereas a relatively high efficiency (over 60%) has been achieved using the screw thread form described above.

During operation of the pump 10 leakage of fluid from the fluid chambers occurs along leakage paths between the flanks F of the meshing threads 20, 20', 26*a*, 26*a'*, 26*b*, 26*b'*, and between the exterior surfaces of the rotors 20, 14*a*, 14*b* and the housing 16 or the thread roots R. Such leakage reduces the efficiency of the pump 10.

Reduction of the thread depth TD reduces the size of the leakage path between the flanks F of meshing threads 20, 20', 26*a*, 26*a'*, 26*b*, 26*b'*, and reduction of the pitch reduces the size of the leakage paths between the outer surfaces and the root surfaces R of the rotors 12, 14*a*, 14*b*, and it is understood that this contributes towards the improved efficiency of the pump 10.

Use of the above described screw thread form also decreases the costs of manufacturing the pump 10.

The rotors 12, 14*a*, 14*b* are typically made by machining the thread forms into a cylindrical metal rod, and the tolerances must be tight in order to ensure that the threads mesh properly without leaving large fluid leakage paths and without the meshing threads becoming jammed during rotation of the rotors 12, 14*a*, 14*b*. The longer the rotor, the more difficult it becomes accurately to control a machine tool to produce a tight tolerance thread over the entire rotor length. Thus, for a given number of thread turns, it is easier, and hence less expensive, to manufacture a tight tolerance thread on the rotors 12, 14*a*, 14*b*, of the present invention than it would be to manufacture a longer rotor with a conventional thread form.

In addition, the complexity and hence cost of machining a tight tolerance thread form decreases with a reduced thread depth. This is at least partly because a reduction in root diameter increases the likelihood of the rotor 12, 14*a*, 14*b* bending during machining, and thus more care must be taken to produce a thread form of the required low tolerance. For a given rotor outer diameter, the root diameter of the rotors 12, 14*a*, 14*b* of the present invention is correspondingly larger than the root diameter of rotors of conventional design.

Various modifications may be made to the pump 10 within the scope of the invention.

For example, the rotors 12, 14*a*, 14*b* may be provided with fewer or more than two threads or flights per rotor. It would be possible, for example to provide three interposed threads on each rotor 12, 14*a*, 14*b* each having a pitch and thread depth as described above.

It is also possible to provide only a single idler rotor, or to provide more than two idler rotors. Moreover, where two or more idler rotors are provided, it is not necessary for the central rotor to be connected to the driving means—one of the outer rotors may be connected to the driving means, or both the central rotor and at least one of the outer rotors may be connected to the driving means.

It is also possible that the central rotor may be fixed relative to the driving means, and rotation of the rotors achieved by rotation of the pump housing about the longitudinal axis of the central rotor, for example by incorporating the pump housing in the rotor of an electric motor.

We claim:

1. A pump including a power rotor and an idler rotor, the rotors each being provided with a generally helical screw thread and being mounted for rotation in a housing such that the screw threads of the rotors mesh and rotation of one rotor causes rotation of the other rotor, the power rotor being connected to a driving means operation of which causes rotation of the power rotor, wherein a pitch of the threads of each rotor is less than 1.6 times the outer diameter of the power rotor, a depth of the threads of each rotor is less than or equal to 0.2 times the outer diameter of the power rotor, and a root diameter of the idler rotor is less than 0.31 times the outer diameter of the power rotor.

2. A pump according to claim 1 wherein the pitch of the threads of each rotor is less than or equal to the outer diameter of the power rotor.

3. A pump according to claim 2 wherein the pitch of the threads of each rotor is at least 0.8 times the outer diameter of the power rotor.

4. A pump according to claim 1 wherein the pitch Of the threads of each rotor is at least 0.5 times the outer diameter of the power rotor.

5. A pump according to claim 1 wherein the thread depth of the screw threads is less than 0.175 times the outer diameter of the power rotor.

6. A pump according to claim 1 wherein the thread depth of the screw threads is at least 0.1 times the outer diameter of the power rotor.

7. A pump according to claim 1 wherein the root diameter of the idler rotor is less than 0.3 times the outer diameter of the power rotor.

8. A pump according to claim 1 wherein the root diameter of the idler rotor is at least 0.1 times the outer diameter of the power rotor.

9. A pump according to claim 1 wherein the root diameter of the idler rotor is between 0.2 and 0.3 times the outer diameter of the power rotor.

10. A pump according to claim 1 wherein the length of the power rotor and idler rotor is less than 200 mm.

11. A pump according to claim 1 wherein the length of the power rotor and idler rotor is less than 100 mm.

12. A pump according to claim 1 wherein the outer diameter of the power rotor is less than 12 mm.

13. A pump according to claim 1 wherein each rotor is provided with two generally helical interposed screw threads.

14. A pump according to claim 1 wherein the pump includes a power rotor and two idler rotors, the power rotor being arranged between the two idler rotors.

15. A pump according to claim 1 wherein the pitch of the screw threads is substantially constant over the length of the rotors.

* * * * *